US007017776B1

(12) United States Patent
Hupp

(10) Patent No.: US 7,017,776 B1
(45) Date of Patent: Mar. 28, 2006

(54) SLIDABLY SEALABLE CONTAINER HAVING AN AUXILIARY TRACK

(75) Inventor: Matthew Todd Hupp, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/480,974

(22) Filed: Jan. 11, 2000

(51) Int. Cl.
*B65D 43/16* (2006.01)

(52) U.S. Cl. ..... 220/834

(58) Field of Classification Search ..... 220/834, 220/4.23
See application file for complete search history.

(56) References Cited

U.S. PATENT DOCUMENTS

| | | | | |
|---|---|---|---|---|
| 2,035,593 | A | | 3/1936 | Coventry |
| 3,660,875 | A | | 5/1972 | Gutman |
| 3,676,159 | A | * | 7/1972 | Fallowfield ..... 383/6 |
| 3,784,055 | A | | 1/1974 | Anderson |
| 3,967,756 | A | | 7/1976 | Barish |
| 4,013,214 | A | | 3/1977 | Hansen et al. |
| 4,541,117 | A | | 9/1985 | Ashbeck |
| 4,576,307 | A | | 3/1986 | Frydenberg |
| 4,576,330 | A | | 3/1986 | Schepp |
| 5,046,659 | A | | 9/1991 | Warburton |
| 5,058,761 | A | | 10/1991 | Williams |
| 5,312,011 | A | * | 5/1994 | Fischer ..... 220/528 |
| 5,339,973 | A | | 8/1994 | Edwards et al. |
| 5,377,860 | A | | 1/1995 | Littlejohn et al. |
| 5,427,266 | A | | 6/1995 | Yun |
| 5,507,407 | A | | 4/1996 | Feer et al. |
| 5,524,990 | A | | 6/1996 | Buck |
| 5,577,627 | A | | 11/1996 | Richie-Dubler |
| 5,651,462 | A | | 7/1997 | Simonsen et al. |
| 5,667,092 | A | | 9/1997 | Julius et al. |
| 5,788,378 | A | * | 8/1998 | Thomas ..... 383/63 |
| 5,860,549 | A | * | 1/1999 | Allers et al. ..... 220/4.23 |
| 5,897,011 | A | * | 4/1999 | Brilliant et al. ..... 220/4.23 |
| 5,996,882 | A | | 12/1999 | Randall |
| 6,092,687 | A | * | 7/2000 | Hupp et al. ..... 220/666 |
| 6,116,501 | A | * | 9/2000 | Hupp ..... 229/125.09 |

FOREIGN PATENT DOCUMENTS

| | | |
|---|---|---|
| DE | 3 144 702 A1 | 5/1983 |
| EP | 0 442 035 A1 | 8/1991 |
| EP | 0 665 170 A1 | 8/1995 |
| WO | WO 98/28995 A1 | 7/1998 |

* cited by examiner

*Primary Examiner*—Stephen Castellano
(74) *Attorney, Agent, or Firm*—David K. Mattheis; Stephen T. Murphy; Leonard W. Lewis

(57) ABSTRACT

A container. The container has an aperture through which contents may be accessed. The aperture is sealable with a cover. The seal is opened or closed with a slider. The slider rides in a track which is congruent with the perimeter of the aperture. A portion of the track diverges from congruency to form an auxiliary track in which the slider may be parked. When parked, the cover may be opened or closed.

10 Claims, 2 Drawing Sheets

SLIDABLY SEALABLE CONTAINER HAVING AN AUXILIARY TRACK

FIELD OF INVENTION

This invention is directed to containers for storage of objects, and more particularly containers which are sealable with a cover.

BACKGROUND OF THE INVENTION

Sealable containers are known in the art. For example, U.S. Pat. No. 3,784,055, iss. Jan. 8, 1974 to Anderson, and U.S. Pat. No. 3,967,756, iss. Jul. 6, 1976 to Barish, incorporated herein by reference, disclose containers having plug seals. However, plug seals require significant manual manipulation to effect tight sealing. Unless the user is careful, such a seal may not perimetrically enclose the aperture through which the contents of the container are to be accessed. Unless full perimetric enclosure is obtained, perishable contents stored in the container may spoil.

Another type of seal is illustrated in commonly assigned U.S. Pat. No. 5,996,882, iss. Dec. 7, 1999 to Randall, and incorporated herein by reference. This patent discloses a container having a closure means activatable by an externally applied force.

One attempt in the art to overcome the problem of having to manipulate a full perimeter closure, without having visual, tactile, or audible signal that full sealing has been obtained, is to use a slider, as illustrated in U.S. Pat. No. 3,660,875, iss. May 9, 1972 to Gutman, and incorporated herein by reference. However, to date, sliders have only been capable of unidirectional operation. Sliders are not capable of operation in an XY plane when used in conjunction with a rigid seal.

U.S. Pat. No. 4,013,214, iss. Mar. 22, 1977 to Hansen et al., discloses a multiple plastic container having a cover with a hinged connection to the base. U.S. Pat. No. 5,046,659, iss. Sep. 9, 1991 to Warburton, discloses a thermoformed plastic container having a locking lid and base. U.S. Pat. No. 5,577,627, iss. Nov. 26, 1996 to Richie-Dubler, discloses a thermoformed plastic container having a lid and base with an integral hinge. U.S. Pat. No. 5,339,973, iss. Aug. 23, 1994 to Edwards et al., discloses a container having a seal flange comprising a curved surface which interlocks over an arc of more than 180 degrees.

U.S. Pat. No. 5,667,092, iss. Sep. 16, 1997 to Julius et al., discloses a container comprising a cover having a lid tray and peripheral flange. U.S. Pat. No. 5,507,407, iss. Apr. 16, 1996 to Feer et al., discloses a container lid having a peripheral flange dimensioned to receive the rim of a container. The flange terminates at a skirt having a lever arm to allow removal of the lid from the container. Likewise, U.S. Pat. No. 5,377,860, iss. Jan. 3, 1995 to Littlejohn et al., discloses a food container having a unitary base and also a unitary lid. U.S. Pat. No. 5,058,761, iss. Oct. 22, 1991 to Williams, discloses a reclosable package having a lid and base fusion bonded and peelably sealed.

U.S. Pat. No. 5,524,990, iss. Jun. 11, 1996 to Buck, discloses a flexible container having a flap which closes the container opening. A stiffening element extends around the periphery of the flap. However, such a container is neither sealable with a slider, nor sealable by manipulating only a limited sector of the stiffening element.

U.S. Pat. No. 4,576,330, iss. Mar. 18, 1986 to Schepp, discloses a tray and hinged lid having a locking engagement internal to a flange. U.S. Pat. No. 4,576,307, iss. Mar. 18, 1986 to Frydenberg, discloses a container having elements held together by a sliding latch. The sliding latch precludes opening of the container by preventing transverse movement of a post/rail combination. U.S. Pat. No. 5,427,266, iss. Jun. 27, 1995 to Yun, discloses a lid with a visual seal indication for proper closure. U.S. Pat. No. 5,651,462, iss. Jul. 29, 1997 to Simonsen et al., discloses a rigid reclosable package having a flexible cover.

None of the aforementioned references disclose a container having a rigid seal extending with vector components in both directions of an X-Y plane and being closable with a slider which is congruently translatable relative to said seal.

SUMMARY OF THE INVENTION

The invention comprises a container closable with a cover. The container has an aperture through which contents of the container may be accessed. The aperture has a perimeter at least partially, and preferably fully perimetrically, sealable therearound with a seal. The container is sealable with a slider. The slider is movable in a path juxtaposed with at least a portion of the perimeter. At least a portion of the track is spaced apart from the seal.

The slider may apply or release the seal as the slider moves along the track to close or open the seal, respectively. The track and seal are congruent for a sector of the perimeter and spaced apart from each other at a point circumferentially displaced from that sector.

In another execution, the invention comprises a method of opening and closing a container. The container has upstanding sidewalls and a removable cover sealingly engaged to an aperture at a perimeter seal. The seal is applied to and released from the aperture by using a slider movable along a track. The method comprises the steps of providing the container and the cover, providing a slider disposed in the track having first and second spaced apart terminal ends, which are also spaced apart from the seal. The slider moves from one terminal end into engagement with the seal. The slider is traced along the track congruent with the seal, whereby the slider open or closes the cover relative to the container as the slider applies or releases the seal, respectively.

DETAILED DESCRIPTION OF THE INVENTION

Figure 1:
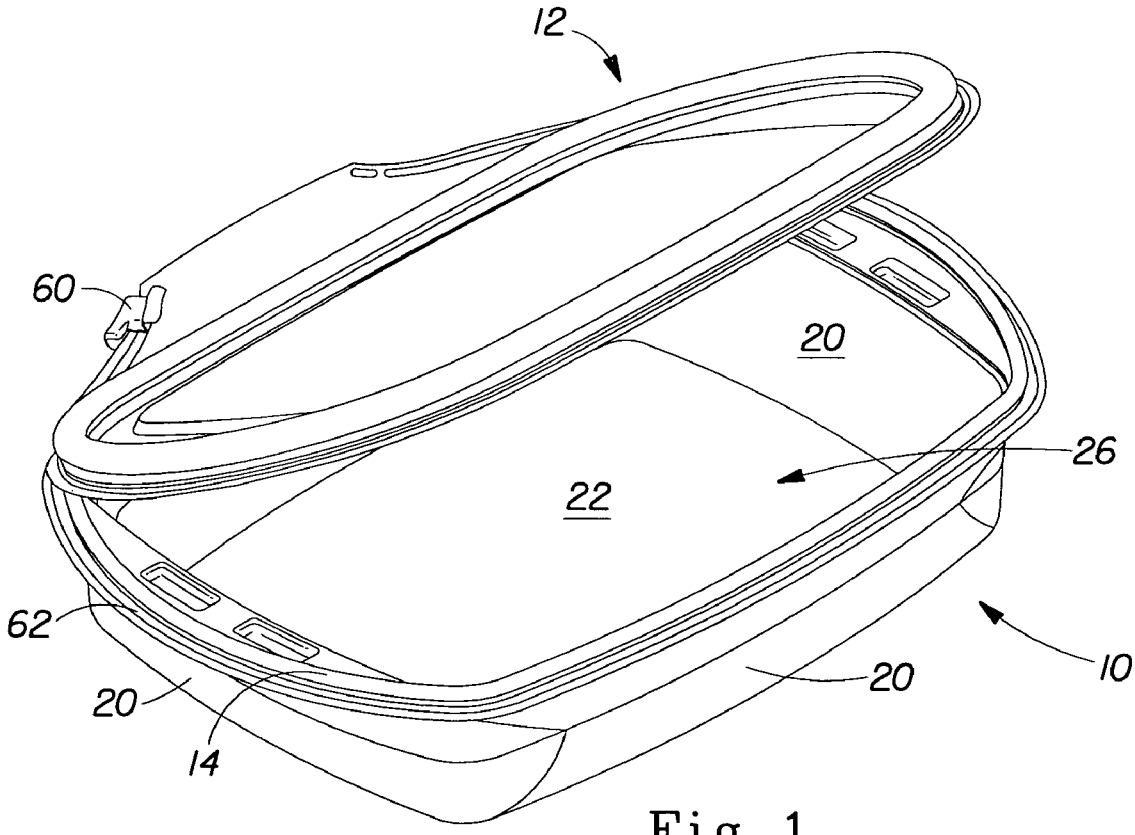
FIG. 1 is a perspective view of a container according to the present invention, illustrating the cover in the open position, and a slider not engaging the seal of the container.

FIG. 1 depicts a preferred embodiment of a container 10 according to the present invention. The container 10 includes a container body preferably unitarily formed from sheet material. A cover 12 is included with the container 10 and may be unitarily formed with the container 10. The container 10 further includes a seal 14 for perimetrically closing the cover 12 onto the seal 14. The seal 14 defines an XY plane, and a Z-direction orthogonal thereto.

The container 10 is reversibly transformable between two conditions, an open condition wherein the cover 12 is removed from the container 10 and the contents of the container 10 may be accessed. The contents of the container 10 may be accessed through an aperture 26. When the cover 12 of the container 10 is in the open position, contents may be inserted into or removed from the container 10.

In the other condition, the container 10 is closed and the cover 12 sealed onto the container 10. The closed condition prevents unintended removal, and potentially tampering with the contents of the container 10. If desired, a lock (not shown) may be included to prevent unauthorized access to the container 10 when the cover 12 is closed.

The cover 12 may be generally congruent and substantially coextensive of the circumference of the container 10 as illustrated. Alternatively, it is to be understood that the aperture 26 and cover 12 may be sized and/or shaped to have a geometry which is different from that of the aperture 26 of the container 10. While the illustrated embodiments show a container 10 having a cover 12 which allows access to the top of the container 10, it is to be understood a cover 12 which is disposed on one or more of the sidewalls 20 or even the bottom of the container 10 may be included. Further, the container 10 may have a plurality of covers 12, as desired. For example, the top of the container 10 may have two smaller covers 12 rather than one large cover 12 or, alternatively, the top of the container 10 may have one cover 12 and one or more sidewalls 20 of the container 10 have additional covers 12. Further, the container 10 may be internally partitioned as desired.

The container 10 is at least partially sealable with the cover 12 when the cover 12 is in the closed position. In some embodiments, it may be desirable that the seal 14 perimetrically enclose the container 10 when the cover 12 is attached. A perimetric closure of the seal 14 may be desired when perishable contents are stored in the container 10 or dust and contamination are to be kept out of the container 10 for hygienic purposes. Alternatively, a partial seal 14 of the container 10 may be desirable when aspiration of the container 10 is sought. For example, if the container 10 is to be used for microwave heating of food contents, venting of the container 10 may be desired.

The container 10 according to the present invention may be relatively small, such that the container 10 may be stored in one's pocket or purse. Such a container 10 may be useful for storing pills, capsules, etc. Alternatively, the container 10 may be relatively large such that the container 10 is sized to fit a flat bed semi-truck. Such a container 10 may be useful for carrying construction materials, etc. One contemplated use for the container 10 is to store perishable items such as food.

The container 10 comprises a floor pan 22 and sidewalls 20 projecting outwardly from the floor pan 22. Preferably, in use, the sidewalls 20 project upwardly and terminate at a distal end forming the aperture 26 of the container 10. The illustrated embodiment has four sidewalls 20. However, it is to be recognized the invention is not so limited. For example, the container 10 may have three or more sidewalls 20, may be round, oval, etc.

The cover 12 may be generally flat, as illustrated, or may have a convex inward or convex outward orientation, as desired. For certain embodiments, it is preferred that the cover 12 be substantially flat so that the container 10 is stackable.

The floor pan 22 defines and lies in a first plane. For the embodiment illustrated, the floor pan 22 is defined by the vertices at the four corners of the upstanding sidewalls 20. The floor pan 22 may be domed convex inwardly to increase strength, as is known in the art. Particularly, domed floor pans 22 provide increased strength for loading by the contents of the container 10 in a direction normal to the floor pan 22. Alternatively, the floor pan 22 may be disposed convex outwardly, although this may be decrease stability when the container 10 rests on a horizontal surface. It is to be recognized and appreciated that the floor pan 22 may be domed as is known in the art yet still define a plane.

The sidewalls 20 are illustrated to be generally perpendicular to and projecting outwardly from the floor pan 22. It is to be recognized that sidewalls 20 which project outwardly in a non-perpendicular orientation, e.g., such as a divergent orientation to provide a greater cross section at the top of the container 10 than at the floor pan 22, are known and may be utilized in accordance with the present invention.

Preferably, but not necessarily, the container 10 is formed from a unitary sheet of material. By forming the container 10 from a unitary sheet of material, the presence of seal 14 lines within the body of the container 10 is eliminated and pathways for leakage are reduced.

Various compositions suitable for constructing the storage containers 10 of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance. Materials found suitable for use in accordance with the present invention include a low density polyethylene film, 10 mil (0.25 millimeters) thickness, commercially available from Chevron under the manufacturer's designation PE1122 and syndiotactic polypropylene of 20 mil (0.5 millimeters) thickness available from Fina Corp. under manufacturer's designation EOD96-28. Further suitable materials include a polyethylene/polypropylene blend. Wood and metal may be used for larger size containers 10.

Optionally, the container 10 may be reversibly erectable and collapsible. Particularly, such a container 10 is reversibly transformable between collapsed and erected conditions. A collapsible container 10 may be made by having a plurality of the sidewalls 20 interconnected and projecting outwardly from the floor pan 22. At least one of the sidewalls 20 may have a hinge line disposed substantially parallel to the plane of the floor pan 22. The hinge line divides the sidewall 20 into upper and lower portions, each of which is articulable about the hinge line when the container 10 is transformed between the collapsed and erected conditions. Preferably, each of the sidewalls 20 has a hinge line and/or an optional gusset to effect collapse and erection. Another form of collapsible container 10 is illustrated in the aforementioned and incorporated U.S. Pat. No. 5,996,882, iss. Dec. 7, 1999 to Randall. If it is desired to make a resiliently deformable container 10, the container 10 may be made according to the teachings of commonly assigned U.S. Pat. No. 5,379,897, iss. Jan. 10, 1995 to Muckenfuhs et al., and incorporated herein by reference. The seal 14 of the present invention, having a slider 60 which activates the seal 14 upon the application of force in the XY plane, is particularly useful for containers 10 which collapse in the Z-direction, as described below. This arrangement reduces occurrences of unintended collapsing of such a container 10, and containers 10 intended to have constant volume.

If desired, the container 10 may further be selectively reinforceable, particularly if the sidewalls 20 of the container 10 are collapsible. The sidewalls 20 may be reinforceable with an upstanding strut removable from the sidewalls 20 without separation from the container 10. The struts is transformable between a first position providing reinforcement to the sidewalls 20 and the second position wherein the strut does not provide reinforcement to the sidewall 20. Such a strut may be proximally articulable and hingedly attached to the container 10 at the juncture of the floor pan 22 and respective sidewall 20.

The reinforcement may further comprise a floor pan 22 support. The floor pan 22 support spans the floor pan 22, and preferably the major axis thereof. If desired, the floor pan 22 support may be unitarily formed with one or more struts which selectively reinforce the sidewalls 20.

Referring to FIG. 1, and examining the aperture 26, the seal 14 and the cover 12 of the container 10 in more detail, the seal 14 may be disposed on a flange 52. The flange 52 is circumjacent the aperture 26 of the container 10, although it is to be understood that in a less preferred embodiment, the seal 14 may be internal to the aperture 26 of the container 10.

The seal 14 is preferably rigid, even though the sidewalls 20 may be flaccid, self-supporting, and/or reversibly collapsible and erectable as noted above. By rigid, it is meant that the seal 14, even if compliant, has vector components extending in both the X and Y directions when the container 10 is in its natural, unconstrained state. Thus, when the container 10 is empty, the seal 14 extends in both the X and Y directions. Further, the aperture 26 of such a container 10 has the same geometry whether the container 10 is empty or filled under normal usage conditions.

A seal 14 is considered to be applied and operable when the cover 12 is in the closed position and the seal 14 resists and contains a static hydraulic pressure of at least 2.5 centimeters of distilled water at 20° C. Such a seal 14 may be tested by filling the container 10 to the appropriate depth, applying the seal 14, then turning the container 10 on its side so that 2.5 centimeters of distilled water are applied at a height of 2.54 centimeters above the seal 14. If no leakage occurs within 15 seconds, the seal 14 is considered to be applied and operable.

The seal 14 defines an XY plane and a Z-direction orthogonal thereto. The seal 14 extends in at least two directions, such that the seal 14 defines a path having multiple vector components in each of the X and Y directions. The seal 14 path may be rectilinear, curvilinear, or a combination thereof.

In one embodiment, the seal 14 may be disposed in two mutually perpendicular directions, one substantially parallel to the X direction and the other substantially parallel to the Y direction. Such directions may be congruent or even coincident the top edge of the sidewalls 20 of the container 10. If so, the seal 14 defines a vertex having a minimum radius of curvature determinable by the specific type of seal 14 to be employed, as discussed below. The vertex defines a Z-direction axis perpendicular to the aforementioned XY plane. It is to be noted that the XY plane so defined may be, and is preferably substantially parallel to the plane defined by the floor pan 22 of the container 10, although skewed plane relationships are specifically contemplated. The seal 14 may lie within the XY plane, and the cover 12 removable in a direction having a Z-direction vector component. It is to be recognized that the cover 12 may be articulable as shown or translatable in the axis of the vertex. In contrast to the slider 60 type geometries illustrated in the aforementioned and incorporated U.S. Pat. No. 3,660,875, iss. May 9, 1972 to Gutman, the seal 14 of the present invention is orthogonal to the axis of the vertex.

If the slider 60 is used, activation of the slider 60 in the closing direction compresses the seal 14. The seal 14 may be thought of as having a longitudinal axis within the XY plane of the path of the seal 14. The slider 60 compresses the seal 14 in a direction substantially perpendicular to the longitudinal axis.

If it is desired to remove the cover 12 from the container 10 without a hingeable articulation as illustrated, guide rails may be joined to and project from the internal or external surfaces of the sidewalls 20 of the container 10. The cover 12 may be joined to the guide rails. The guide rails may have slots extending perpendicular to the XY plane of the seal 14. The cover 12 is thus translatable perpendicular to the XY plane by movement along the guide rails.

Whether an articulable cover 12 is selected, or a cover 12 translatably removable from the aperture 26 of the container 10 is selected, in either case, the cover 12 may not necessarily separate from the container 10 even though it is removable therefrom. By not being separable from the container 10, it is meant that the cover 12 cannot be permanently displaced apart from the container 10 without tearing or gross deformation of the material comprising either the container 10, the cover 12, or any members connecting or adjoining the container 10 to the cover 12. By not separating the cover 12 from the container 10, the benefit occurs that the cover 12 does not become misplaced, lost, or intermixed with covers 12 from like-sized containers 10 having different hygienic or sanitary requirements.

Figure 3:
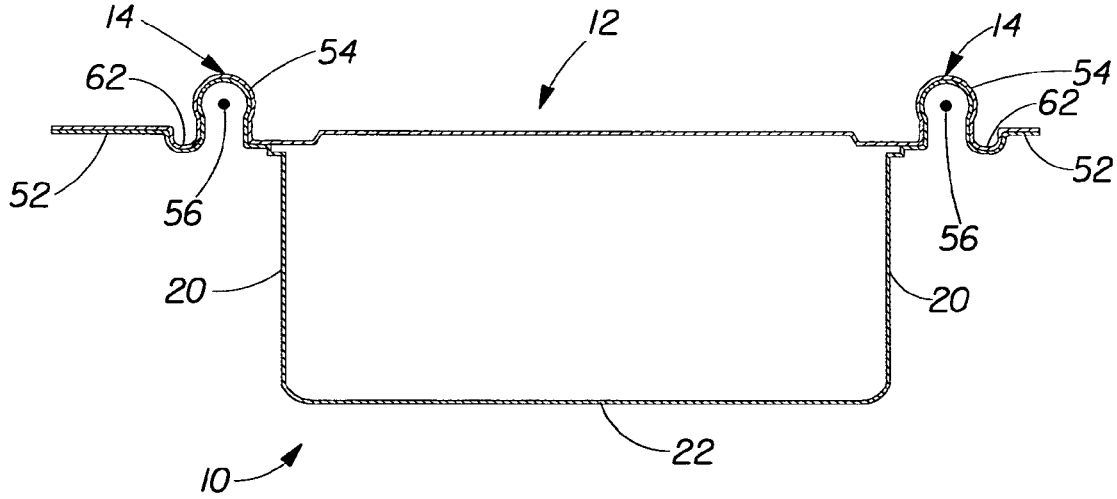
FIG. 3 is a vertical sectional view taken along lines 3—3 of FIG. 2.

Referring to FIG. 3, the seal 14 may comprise any type of reusable mechanism known in the art. Suitable seals 14 include fin seals 14, adhesive seals 14, cohesive seals 14, selectively activatable adhesives as illustrated by commonly assigned U.S. Pat. No. 5,662,758, iss. Oct. 2, 1997 in the names of Hamilton et al., U.S. Pat. No. 5,871,067, iss. Feb. 16, 1999 in the names of Hamilton et al., application Ser. No. 08/745,339, filed Nov. 8, 1996 in the name of McGuire et al., and application Ser. No. 08/745,340, filed Nov. 8, 1996 in the name of Hamilton et al., incorporated herein by reference, and seals 14 having a friction fit or a compression fit, as illustrated. By reusable, it is meant that the cover 12 of the container 10 may be reversibly transformed between each of the open and closed positions at least two times and still functionally seal 14 the container 10.

One suitable type of seal 14, as illustrated, utilizes complementary projections 54 and recesses 56. It is to be understood that the illustrated embodiment utilizes a flange 52 extending in the XY plane. The flange 52 is circumjacent the aperture 26 of the container 10. The flange 52 has a projection 54 extending normal to the XY plane. The cover 12 has a recess 56 extending normal to the XY plane and complementary with the projection 54. The projection 54 is inserted into the recess 56, providing a compression seal 14 which extends at least partially, and preferably perimetrically around the aperture 26 of the container 10.

It is to be understood by one of ordinary skill that this disposition may be reversed, so that the recess 56 is disposed in the flange 52 of the container 10. Further, the cover 12 of the container 10 may also have a flange 52 also extending in the XY plane.

If desired, the container 10 may be sealable with a slider 60. As used herein, a slider 60 is an apparatus which moves along the aforementioned path of the seal 14 to open, close, or preferably open and close the seal 14.

Figure 2:
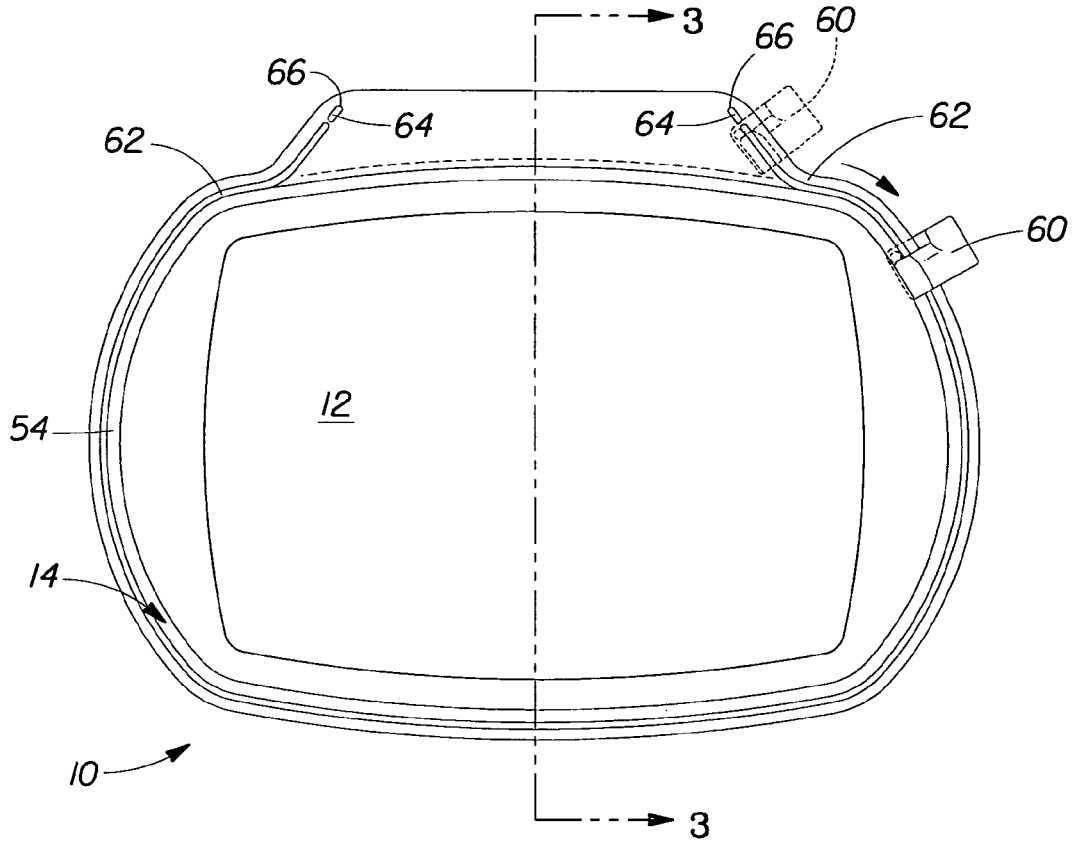
FIG. 2 is a top plan view of the container of FIG. 1 showing the cover in the closed condition and the slider having moved from a position which does not engage the seal to a position which does engage the seal.

Referring to FIG. 2, if the optional slider 60 is included with the container 10 and cover 12, the slider 60 may be movable in a path juxtaposed with the perimeter of the aperture 26. It is to be understood that the seal 14 need not be coincident or juxtaposed with the perimeter of the aperture 26 of the container 10.

The slider 60 may activate the seal 14, whereby the slider 60 applies the seal 14 when moved in a first direction and releases the seal 14 when moved in the opposite direction. Thus, activation of the seal 14 includes either application of the seal 14, such as desired for closing the container 10, or release of the seal 14, such as desired for opening the container 10, or both.

The slider 60 may be disposed in a track 62, thus distinguishing the slider 60 of the present invention from and insuring the slider 60 of the present invention does not include an ordinary zipper. The track 62 is spaced apart from the seal 14. In the illustrated embodiments, the track 62 is outboard of the seal 14, it being understood the track 62 could be inboard of the seal 14 as well. The track 62 is in operative association with the seal 14, whereby the slider 60 can be disposed in the track 62, and still activate the seal 14 in either or both of the apply and release directions. The track 62 is preferably congruent with the seal 14, as illustrated.

The slider 60 is preferably frustroconically shaped. The inside of the slider 60 applies the seal 14 upon activation in the closing direction. The outside of the slider 60 releases the seal 14 upon activation in the opening direction. A suitable slider 60 for use with the present invention is disclosed in the commonly assigned U.S. patent application filed of even date herewith in the name of Hupp and entitled "Slider Applying Opening Or Closing Forces to A Reclosable Fastener Lying In A Two Dimensional Plane", which application is incorporated herein by reference.

It is to be recognized that there are various configurations comprising an appropriate seal 14/track 62 combination. Generally, any geometry having a friction, interference, or compression fit of the seal 14 against parent material of either the container 10 or cover 12 while also providing a guide surface for the slider 60 will be suitable. It is to be recognized that the guide surface, and hence the track 62, will be spaced apart from the seal 14.

The track 62 may, and preferably does, further comprise one or more auxiliary tracks 64. The auxiliary tracks 64 are defined as those portions of the track 62 which are not operatively juxtaposed with the seal 14. The slider 60 may ride in the track 62 until it no longer engages the seal 14, then enters the auxiliary track 64. When the slider 60 is disposed in the auxiliary track 64, the slider 60 does not engage, and thus cannot activate, the seal 14. The auxiliary track 64 may be disposed radially outward of the seal 14, as illustrated, or, if the track 62 is inboard of the seal 14, may be disposed radially inward of the seal 14. Preferably, the auxiliary track 64 does not cross the seal 14, otherwise a perimetric seal 14 will not occur unless engagement occurs at the top of the seal 14.

In the external track 62 embodiment, the container 10 is perimetrically enclosable by the seal 14, a benefit not previously obtainable. The seal 14 is circumferentially applied and released, with or without the slider 60, around the perimeter of the aperture 26. The seal 14 may be applied, at least partially around the perimeter of the aperture 26, by activation, manually or with a slider 60, beginning at a first circumferential position and continuing in serial fashion around the container 10 to a second position circumferentially spaced apart from the first position. The cover 12 is attached to the container 10 at yet a third circumferential position. The third position is circumferentially juxtaposed with at least one of the first position and second positions, and preferably both such positions, as illustrated.

Referring still to FIG. 2, two auxiliary tracks 64 are shown. The cover 12 is hingedly attached to the container 10 at the third position. The auxiliary tracks 64 circumferentially bound the hinged attachment of the cover 12 to the container 10. Thus, preferably, the container 10 has two auxiliary tracks 64 as illustrated. With this arrangement, the slider 60 can be parked in one auxiliary track 64 upon translation in the opening direction, so that the slider 60 does not interfere with opening of or access to the contents of the container 10. Likewise, the slider 60 can be parked in the other auxiliary track 64 upon activation of the seal 14 in the closing direction. It is, of course, recognized that the slider 60 may be parked in the auxiliary track 64 at a position not juxtaposed with the hinge or other means for attaching the cover 12 to the container 10.

In the auxiliary track 64, the terminal end 66 of the slider 60 need only be spaced apart from the seal 14 a distance sufficient to allow the slider 60 to clear the seal 14, so that the cover 12 may be opened or closed as desired without interference from the slider 60. For the embodiments illustrated, a slider 60 having a width in the radial direction, the terminal ends 66 of the auxiliary tracks 64 are spaced outwardly, in the radial direction, from the seal 14 a distance sufficient to accommodate the width of the seal 14 and the width of the slider 60.

It is not necessary that the auxiliary track 64 have a terminal end 66 which predisposes the slider 60 to park in a particular position. If desired, the slider 60 may be removed from the auxiliary track 64, and thus separated from the seal 14 and container 10. Such an arrangement may be useful where it is desired to independently clean or refurbish the slider 60.

In an alternative embodiment (not shown), the slider 60 may be parked in a position juxtaposed with, or even coincident the seal 14. In such an arrangement, the cover 12 may have a cut-out which allows the cover 12 to clear the slider 60 so that the cover 12 may be opened from the aperture 26 of the container 10 without interference from the slider 60.

In operation, the container 10 is at least partially and preferably perimetrically sealable upon closure by the cover 12. The seal 14 subtends a first sector of the perimeter. The first sector preferably subtends at least 270 degrees, more preferably subtends 360 degrees. The seal 14 may be fully applied throughout the first sector, by activation in the closing direction, of a second sector of the seal 14. The second sector is less than and included within the first sector. The second sector preferably subtends an angle of 260 to 360 degrees, and preferably at least 290 degrees. As illustrated, the hinge may be disposed circumferentially outside of the second sector. Thus, the slider 60, and any other manual manipulation or activation of the seal 14, does not intercept the hinge.

If desired, the container 10 and cover 12 may comprise two or more seals 14 disposed in series. Such seals 14 may be radially offset so that multiple occurrences of leakage through the seal 14 are required before the cover 12 is breached. Alternatively, an individual seal 14 may comprise two or more sliders 60. In such an arrangement, each slider 60 subtends a portion of the first sector.

What is claimed is:

1. A container comprising a container body having an aperture having an aperture perimeter therearound, a cover having a perimeter therearound which corresponds to the perimeter around the aperture of the body, a seal at least partially juxtaposed to said aperture perimeter, and a slider, said container closable with the cover and at least partially sealable therearound with the seal, the slider structured such that the manipulation of the slider fully activates the seal, said container further comprising a track juxtaposed to, but being radially spaced apart from said seal, whereby said slider is movable in the track said track comprising an auxiliary track not operatively juxtaposed with the seal.

2. A container according to claim 1, said container being openable or closable with the slider movable along the track, whereby said slider applies or releases a seal as said slider moves along said track, said track and said seal being congruent for a sector of said aperture perimeter and being spaced apart from each other at a point circumferentially displaced from said sector.

3. A container according to claim 1, sealable around said entire aperture perimeter.

4. A container according to claim 3, comprising upstanding walls wherein said seal is disposed on a flange circumjacent said upstanding walls.

5. A container according to claim 4, wherein said seal is leak resistant.

6. A container according to claim 5, wherein said seal comprises a compression seal.

7. A container according to claim 6, wherein said seal comprises a C-shaped cross section.

8. A container according to claim 2, wherein said seal subtends a first sector, and said track subtends a second sector, said first sector being greater than said second sector.

9. A container according to claim 1, wherein said track has at least one terminal end disposed outboard of said seal.

10. A container according to claim 9 further comprising a hinge which attaches the cover to the container body, wherein said hinge is disposed outboard of said seal.

* * * * *